US005472088A

United States Patent [19]

Roberts et al.

[11] Patent Number: 5,472,088

[45] Date of Patent: Dec. 5, 1995

[54] FILM TRANSPORT CONTAINER

[76] Inventors: Bobby Roberts, 9249 Burton Way, Beverly Hills, Calif. 90210; Roger Paglia, 23802 Valley Oak Ct., Santa Clarita, Calif. 91321

[21] Appl. No.: 136,101

[22] Filed: Oct. 13, 1993

[51] Int. Cl.[6] ..... B65D 85/66

[52] U.S. Cl. ..... 206/394; 206/403; 206/408

[58] Field of Search ..... 206/389, 391, 206/393, 394, 398, 53, 403, 407, 408, 413, 414, 415; 53/266.1

[56] References Cited

U.S. PATENT DOCUMENTS 4,079,835 3/1978 Kendig ..... 206/408 X 4,570,794 2/1986 Capitao, Jr. ..... 206/394

5,053,811 10/1991 Watabe et al. ..... 206/397 X 5,193,680 3/1993 Schumann et al. ..... 206/408 X

*Primary Examiner*—Jacob K. Ackun

[57] ABSTRACT

A transport container for transporting theatrical release prints mounted on plastic cores of the character used by film processing laboratories. The container is used to safely and securely ship the release prints directly from the processing laboratory to the theater and is designed so that the print can be conveniently unwound out of the container by the theater projectionist and directly wound onto the theater platter for display.

16 Claims, 6 Drawing Sheets

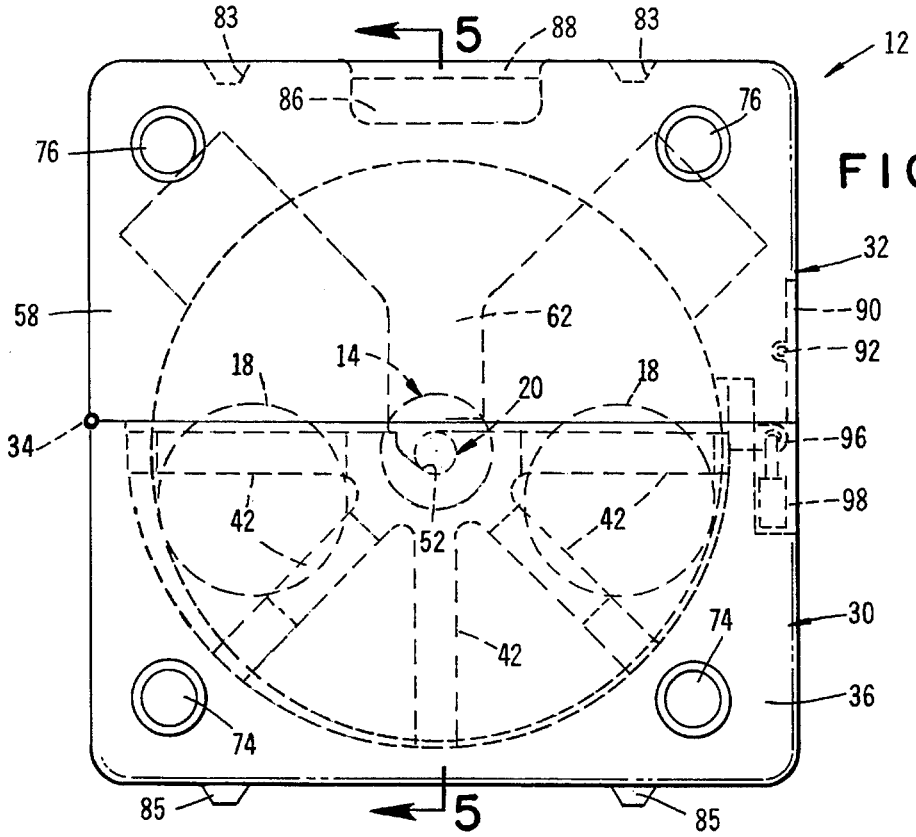
FIG. 2
FIG. 3
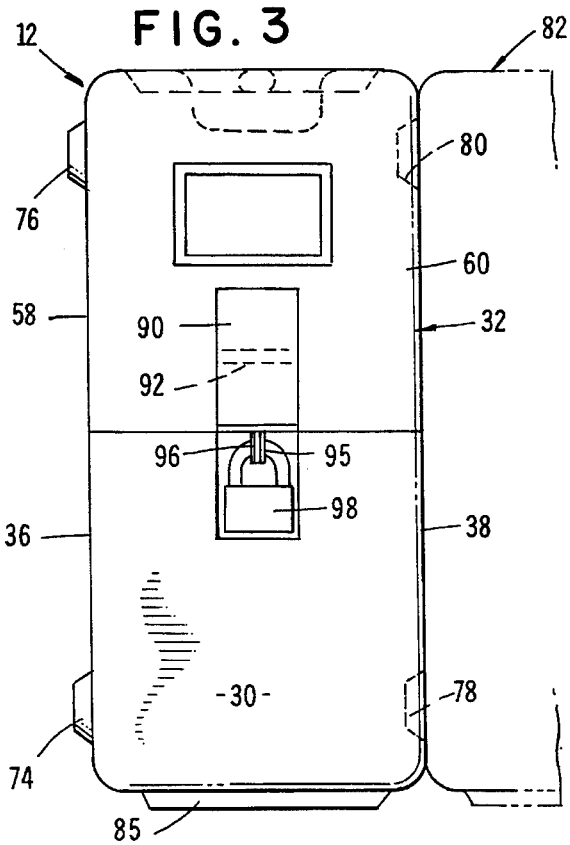
FIG. 4
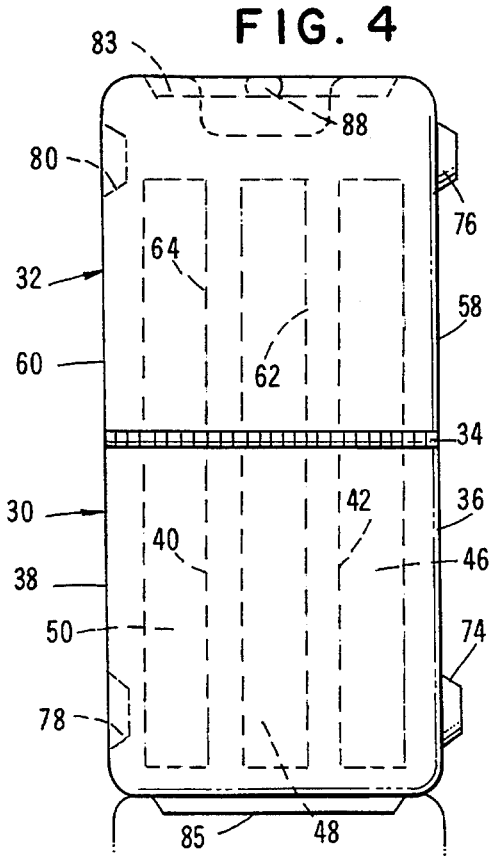

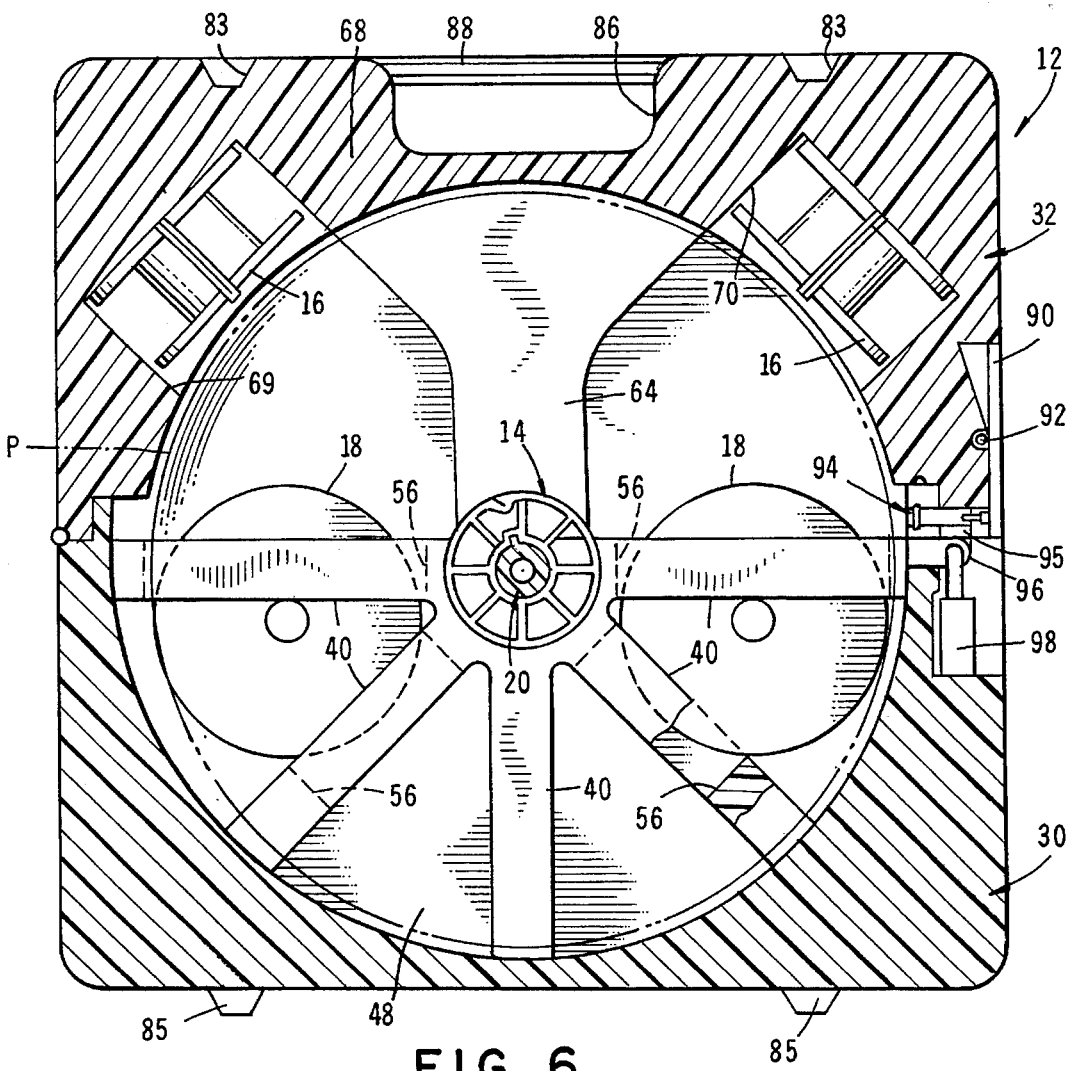
FIG. 6
FIG. 10
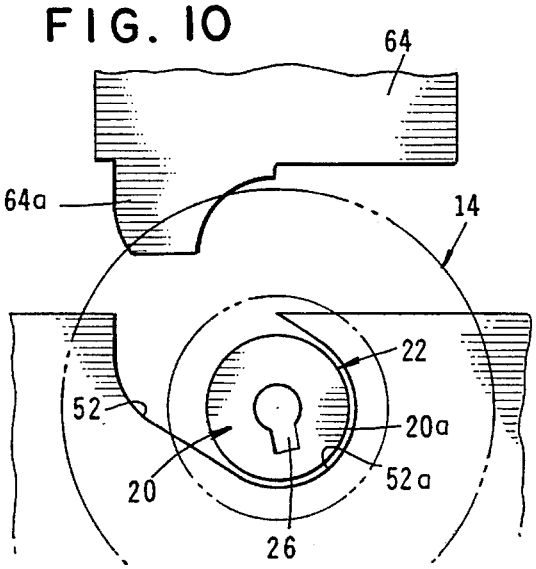
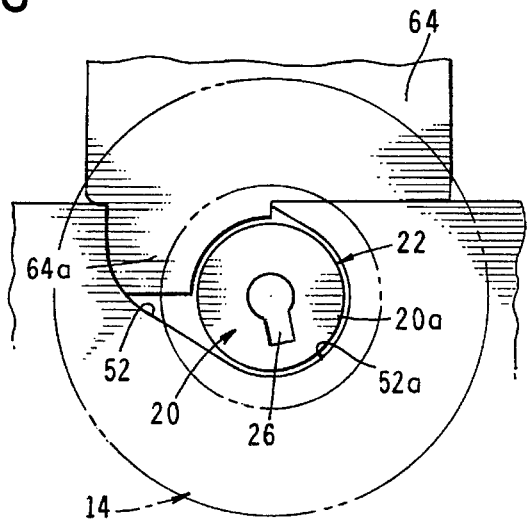
FIG. 11

FIG. 7
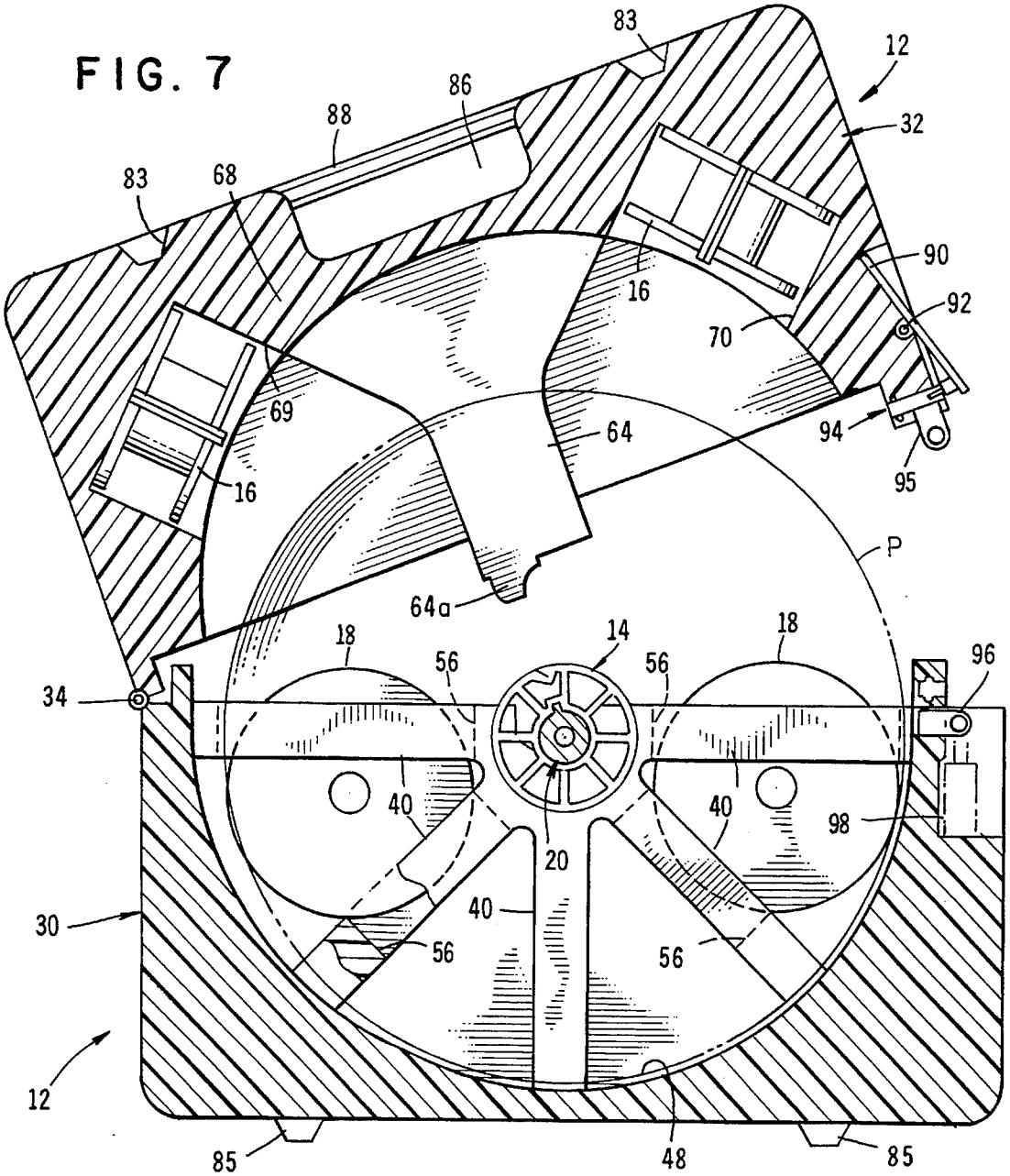
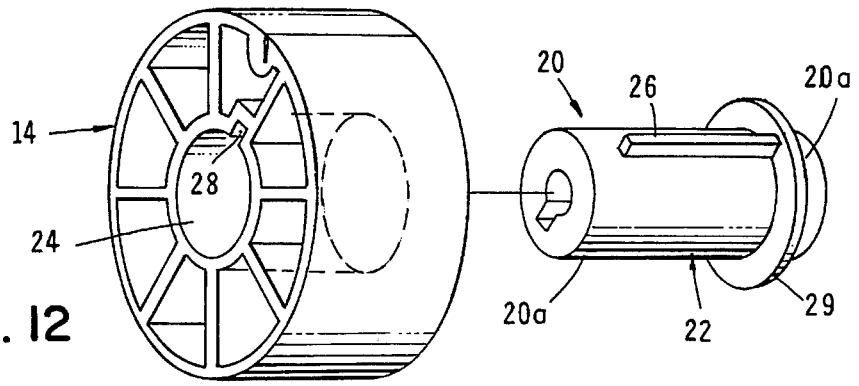
FIG. 12

FILM TRANSPORT CONTAINER

BACKGROUND OF THE INVENTION

1. Field of the Invention

The present invention relates generally to containers designed for shipping film. More particularly, the invention concerns a cost-effective shipping container designed to carry theatrical release prints and the method of using the container in the transport and platter mounting of the prints.

2. Discussion of the Invention

In the past, theatrical release prints were customarily mounted onto plastic film cores at the film laboratory. The mounted prints were then placed in boxes and shipped to the film depot where the prints were transferred from the core onto plastic or metal film reels. Typically, the film reels were then placed in steel shipping cases for transport to the theaters. At the theater, the film reels were removed from the shipping cases and then, often through the use of rather elaborate equipment, the film was transferred from the reels onto a large film platter for later projection.

In view of the fact that a typical motion picture requires five or six film reels, it can readily be appreciated that significant costs were involved in the prior art process of first boxing the core-mounted release prints, then shipping the boxes from the laboratory to the film depot, next removing the prints from the boxes and then finally transferring the prints to the individual film reels.

The present invention uniquely overcomes many of the drawbacks of the prior art print handling processes by eliminating several costly steps involved transporting the theatrical prints from the film processing laboratory to the theater.

More particularly, because the transport container of the invention is uniquely designed to receive the core-mounted prints directly from the processing laboratory, the cost of boxing the prints and then shipping them to the first depot is eliminated. Also eliminated is the cost of the reels themselves since the core-mounted prints are delivered directly to the theater for transfer to the film platter directly from the transport container. Because the intermediate step of transferring the core-mounted prints to the reels at the film depot and then shipping the reels to the theater is completely eliminated, the substantial labor and shipping costs involved in this step are also avoided.

SUMMARY OF THE INVENTION

It is an object of the present invention to provide a transport container which is uniquely designed and constructed to enable the safe and convenient transport of theatrical prints wound on plastic cores of the character used by film processing laboratories.

More particularly, it is an object of the invention to provide a transport container of the aforementioned character and the method of its use whereby the core-mounted prints are maintained in a secure and clean environment for shipment directly from the processing laboratory to the theater.

Another object of the invention is to provide a transport container of the type described in the preceding paragraphs which is constructed so that the prints can be conveniently removed by the theater operator and assembled for platter display by unwinding the prints directly at the transport container.

Another object of the invention is to provide a transport container for transporting core-mounted theatrical prints which is lightweight and easy to handle and yet is extremely durable.

Still another object of the invention is to provide a transport container of the class described which can be used to simultaneously transport not only the feature prints, but also short subject or trailer prints and audio disks as well.

Another object of the invention is to provide a transport container as described in the preceding paragraphs which can be safely nested with similar containers in a manner to prevent relative movement between the nested containers.

Yet another object of the invention is to provide a transport container of the class described which can be securely locked to prevent unauthorized removal of the film therefrom.

BRIEF DESCRIPTION OF THE DRAWINGS

FIG. 2 is a side elevational view of the transport container.

FIG. 3 is a front view of a pair of the transport containers shown in a nesting relationship.

FIG. 4 is a rear view of the transport container of FIG. 1.

FIG. 6 is a cross-sectional view taken along lines 6—6 of FIG. 5.

FIG. 7 is a cross-sectional view similar to FIG. 6 but showing the cover of the transport container in a partially opened position.

FIG. 10 is an enlarged, fragmentary, generally diagrammatic view illustrating the bearing means of the invention for rotatably supporting axles of the character that can be inserted into the central bore of the core upon which the film is wound and also illustrating the retaining means, or retaining fingers, which retain the axle within the bearing means.

FIG. 11 is a diagrammatic view similar to FIG. 10 but showing the locking means moved into proximity with the axle of the apparatus.

FIG. 12 is an enlarged, generally perspective view of the film core and the axle means of the invention which is interconnectable with the core for rotation therewith.

DESCRIPTION OF THE INVENTION

Figure 1:
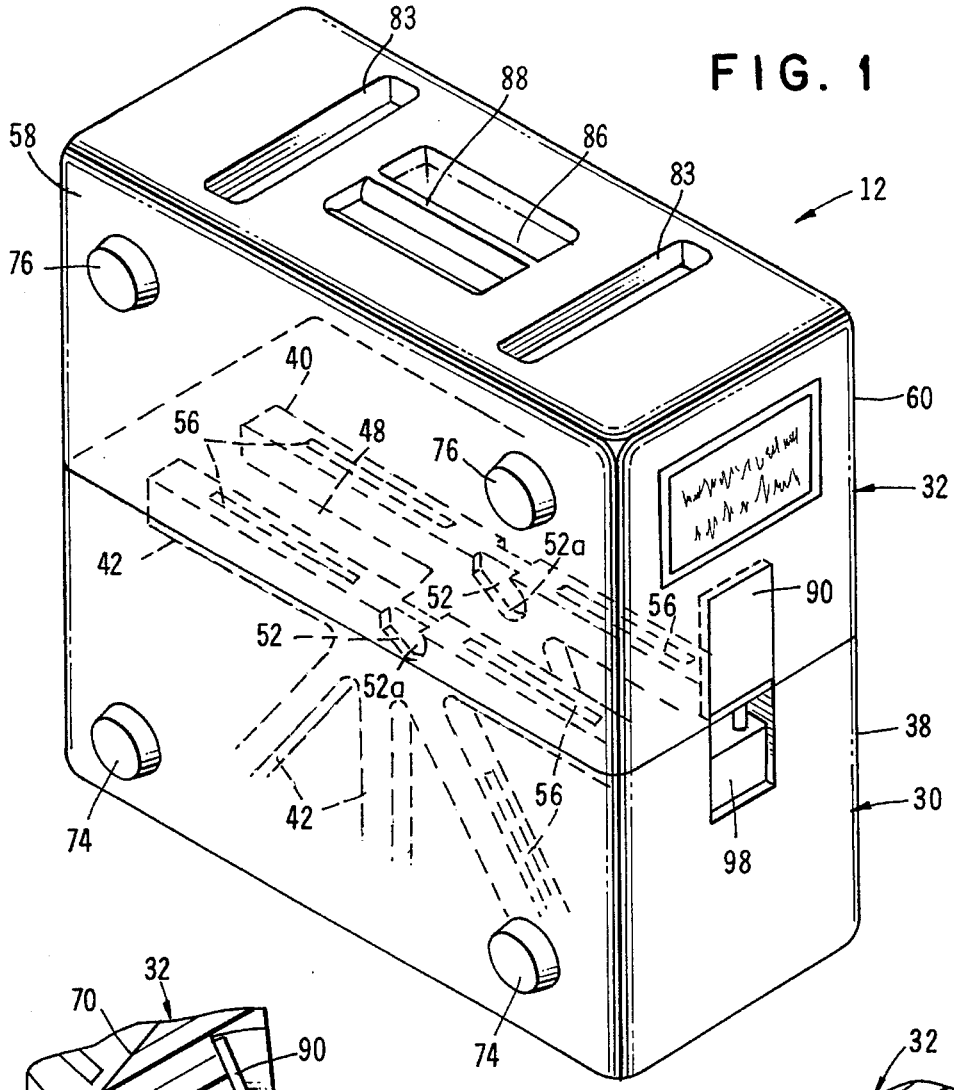
FIG. 1 is a generally perspective view of one form of the transport container of the present invention.

Referring to the drawings and particularly to FIGS. 1 through 4, one form of the transport container of the present invention for transporting theatrical release prints is there illustrated and generally designated by the numeral 12. The transport container of the invention is specially designed for transporting theatrical release prints "P" which are wound upon a central core 14 of the character best seen in FIG. 12. The transport container is also adapted to transport short subjects or trailer prints which are wound on small reels such as reels 16 (FIG. 7). As shown in FIG. 7, the transport container includes means for removably supporting a plurality of audio disks such as compact disks 18.

As best seen in FIGS. 7 and 12, axle means, shown here as axles 20 are provided for interconnection with cores 14 for rotation therewith. Each axle 20, which can be constructed of metal, plastic or wood, includes a generally cylindrically shaped shank portion 22 which is closely receivable within a central bore 24 provided in each of the cores 14 to form a rotatable subassembly. Shank 22 includes a longitudinally extending key 26 which is closely receivable within a keyway 28 provided in the core so that rotation of the core will impart concomitant rotation to the axle 20. Provided at one end of shank 22 of each axle is a collar member 28 that engages the outer surface of core 14 when the axle member is fully inserted into bore 24.

Figure 13:
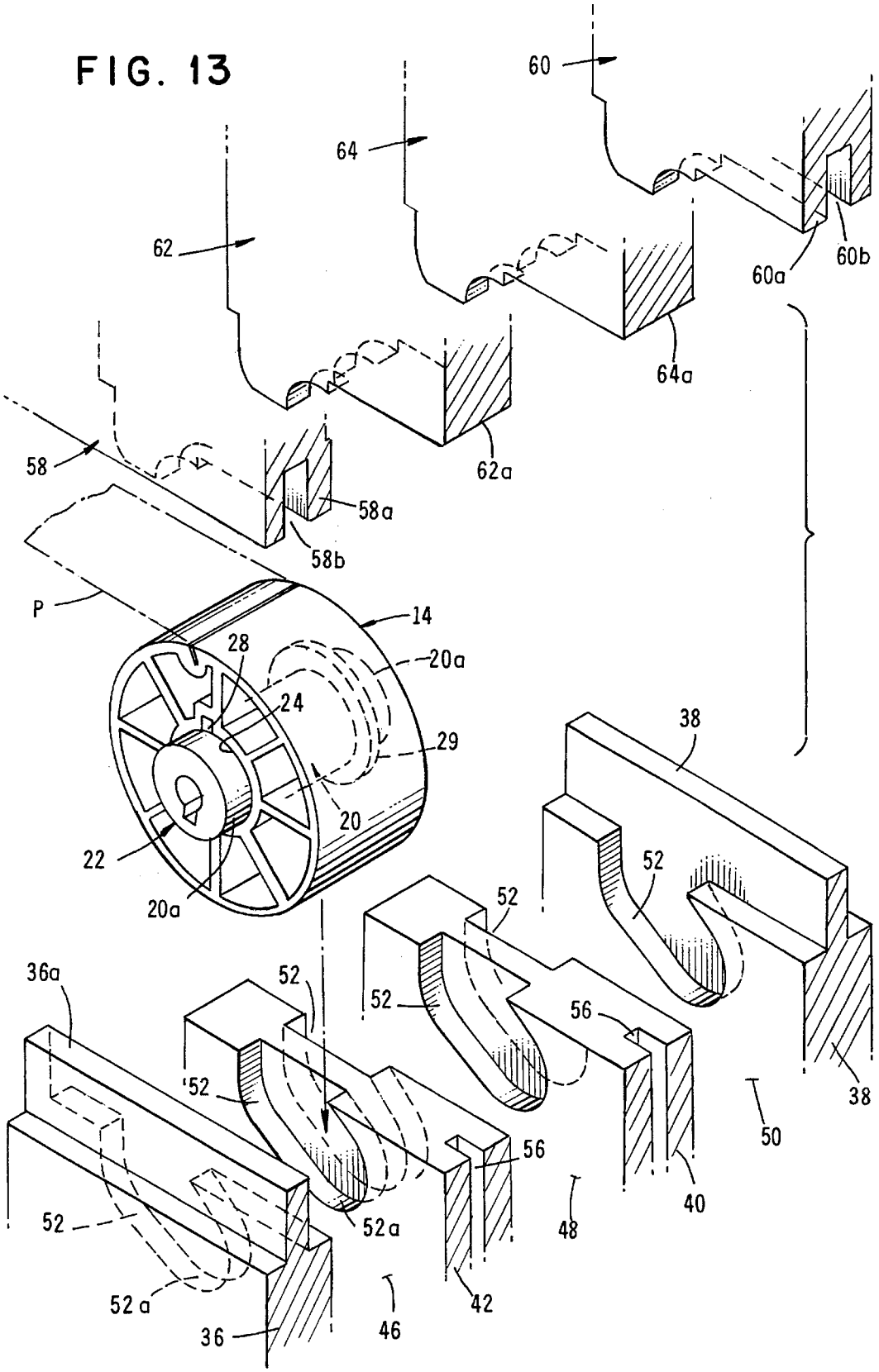
FIG. 13 is an enlarged, fragmentary perspective view illustrating the manner in which the core and axle assembly is removably receivable within the bearing means or axle saddles provided in the base of the container and also illustrating the manner in which the retaining means of the cover cooperates with the base to retain the axles within the bearing means.

Turning once again to FIGS. 1 and 2, the transport container of the present embodiment of the invention comprises a base assembly 30 to which a cover means, or cover assembly 32 is hingeably connected by means of a conventional hinge 34 (FIGS. 2 and 4). Base 30 comprises first and second spaced-apart side walls 36 and 38 (FIG. 3) and first and second spaced-apart intermediate walls 40 and 42 which are disposed between sidewalls 36 and 38. As best seen by also referring to FIGS. 4 and 5, walls 36 and 42 define a first film receiving cavity 46 while walls 40 and 42 define a second film receiving cavity 48. Similarly, walls 38 and 40 define a third film receiving cavity 50. Bearing means are provided in each of the side and intermediate walls for rotatably supporting the axles 20 (see FIG. 5). Turning also to FIG. 13, it can be seen that, in the present form of the invention, the bearing means comprise saddle-like openings 52 which rotatably receive the hub portions **20*a* of axles 20. As indicated in FIGS. 1 and 13, saddle-like openings 52 are generally "J" shaped in plan and each includes a generally semi-circular, lower portion 52*a* which receives the hub portion 20*a* of axles 20 when the rotatable subassembly comprises the core, the axle and the release prints are placed within the container for transport. With this construction, upon rotation of the film core, the axle 20 is free to rotate within the bearing means or saddles 52 of the side and intermediate walls of base 30**. With this construction, when the container reaches the theater, the feature film release prints can be wound onto the projection platter by unwinding the prints directly from the transport container.

Turning now particularly to FIGS. 1, 2 and 7, it is to be observed that intermediate walls 40 and 42 are slotted to form disk receiving cavities for closely receiving the previously mentioned audio or compact disks 18. With this novel arrangement, not only can the feature film segments of the theatrical release prints be readily transported in the transport container, but related audio material can also be simultaneously transported.

Figure 5:
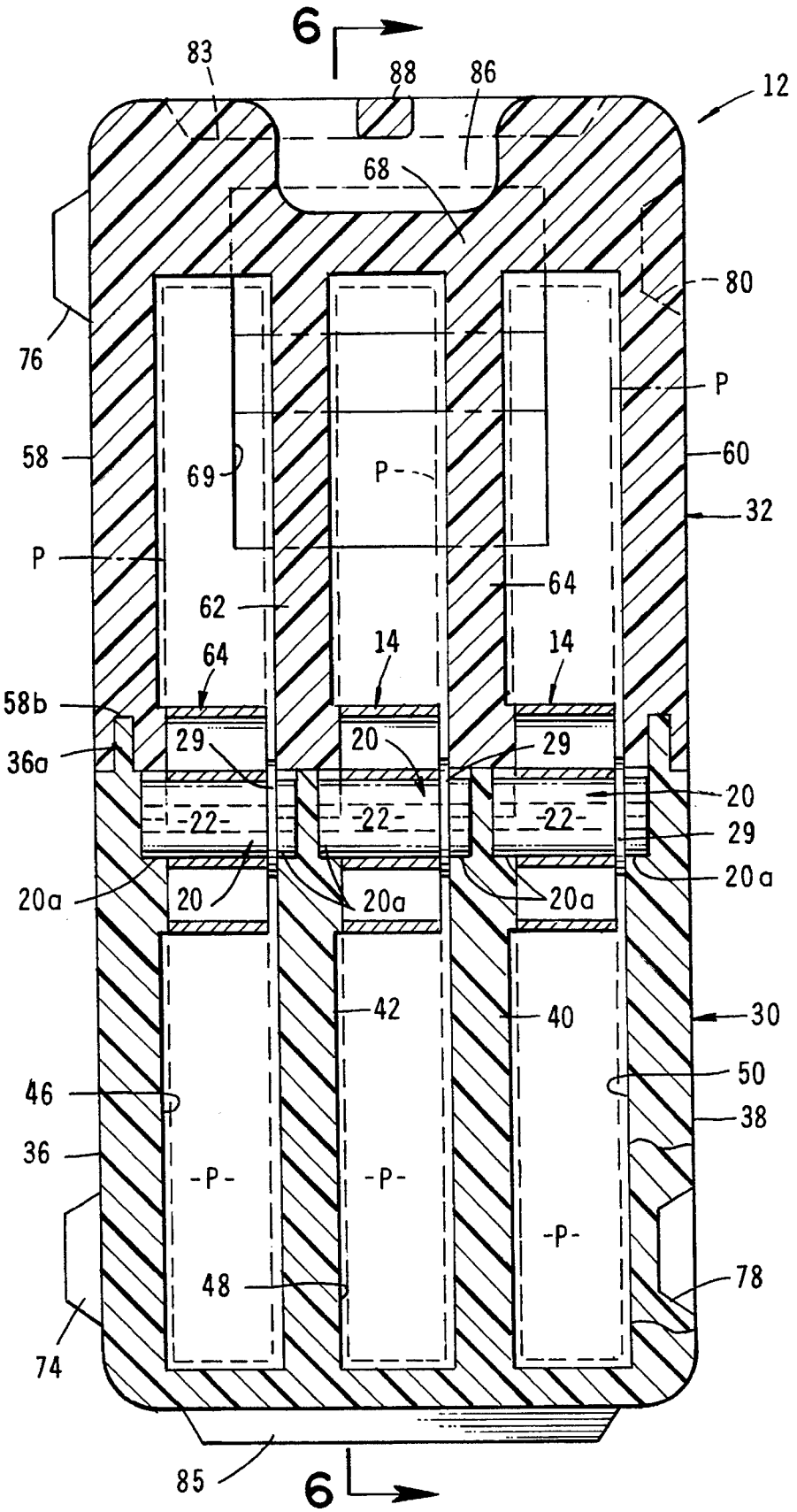
FIG. 5 is a cross-sectional view taken along lines 5—5 of FIG. 2.

Turning next to FIGS. 4 and 5, cover 32 can be seen to comprise first and second spaced-apart side walls 58 and 60 and spaced-apart intermediate walls 62 and 64 which are disposed between side walls 58 and 60. Intermediate walls 62 and 64 depend downwardly from upper wall 68 of the cover and each is provided with retaining means for retaining axles 20 within the saddles 52 formed in the intermediate walls 40 and 42 of base 30. Walls 62 and 64 are of the general configuration illustrated in FIG. 7 and, as shown in FIG. 13, each terminates in finger-like portions **62*a* and 64*a*. With this construction, as cover 32 is moved from the open position shown in FIG. 7 to the closed position shown in FIG. 6, finger portions 62*a* and 64*a* will move arcuately downwardly toward the "J" shaped saddles 52 provided in base walls 40 and 42 and into close proximity with the hub portions 20*a* of the axles which are disposed within the saddles. FIGS. 10 and 11 further illustrate the movement of the retaining means from the open position shown in FIG. 10 to the closed position shown in FIG. 11. More particularly, as indicated in FIGS. 10 and 11, as the cover moves into its closed position, the finger portions of the intermediate walls will move into saddles 52 and into close engagement with the hub portions 20*a*** of the axles nesting therewithin so as to lock the axles securely within the "J" shaped saddles.

As is also shown in FIG. 13, side walls 58 and 60 are similarly provided with retaining means of the general character as those provided on the intermediate walls. These retaining means function to secure the hub portions **20*a* of the axles disposed within the "J" saddles 52 formed in base walls 36 and 38. As before, side walls 58 and 60 also terminate in finger-like portions 58*a* and 60*a* which are configured so as to move into saddles 52 provided in the side walls of the base as cover 32 pivots into the closed position shown in FIG. 6. It is to be noted that walls 36 and 38 are provided with upstanding tongues 36*a* and 38*a* which are received within grooves 58*b* and 60*b* of walls 58 and 60. This tongue and groove arrangement assures proper alignment of the side walls as the cover is moved into a closed position. With this unique construction, each of the feature film segments that are placed within cavities 46, 48 and 50 of base 30** will be maintained securely in position during transport of the film from the film processing laboratory to the theater.

Another novel feature of the transport container of the present invention resides in the provision within the upper wall 68 of cover 32 of cavities or chambers 69 and 70 (FIGS. 6 and 7). These chambers are uniquely configured to closely receive the previously identified small reels 16 upon which short subjects or trailers are wound. These shorter lengths of film are placed within a transport container at the film laboratory and remain in the container until they are removed at the theater by the theater projectionist.

Referring to FIG. 3, another novel feature of the transport container of the present invention is there illustrated. In order that the transport containers can be safely stacked one upon another, nesting means are provided for preventing relative movement of one transport container relative to the container disposed adjacent thereto. In the present form of the invention, this nesting means comprises a pair of protuberances 74 provided on side wall 36 of base 30 and a pair of nesting protuberances 76 provided on side wall 58 of cover 32 (see also FIG. 2). The opposite side walls, 38 and 60 of the base and cover respectively, are provided with nesting cavities 78 and 80 respectively which are configured to closely receive the protuberances formed on the next adjacent shipping container designated in FIG. 3 by the numeral 82. With this construction, transport container 82 can be positioned proximate container 12 in the manner shown in FIG. 3 and will be locked against relative movement by the nesting means. As best seen in FIGS. 1 and 3, the top wall of cover 32 is also provided with nesting channels 83 which receive transversely extending bar-like protuberances 85 provided on base 30. These aspects of the nesting means permits safe stacking of one container on top of another.

To enable the easy lifting of the transport container, upper wall of each container cover 32 is provided with a finger receiving cavity 86, across which a gripping bar 88 extends for secure gripping by the fingers of the person lifting the transport container.

Figure 8:
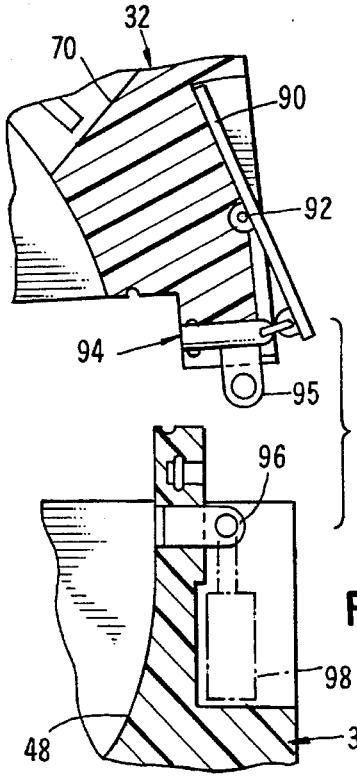
FIG. 8 is an enlarged, fragmentary, cross-sectional view of the front portions of the transport container illustrating one form of locking means of the invention for locking the cover to the base.
Figure 9:
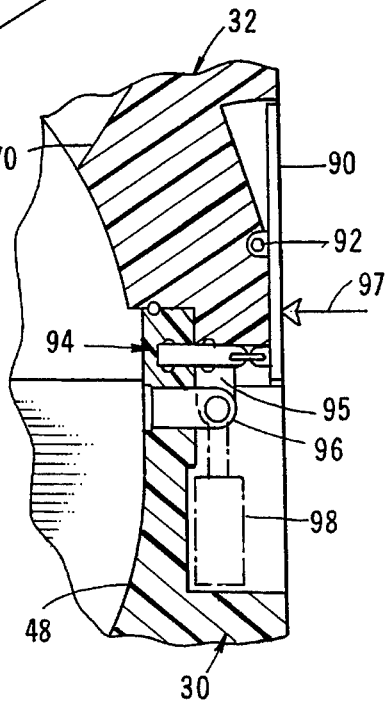
FIG. 9 is an enlarged cross-sectional view similar to FIG. 8 but showing the cover in locking engagement with the base.

Turning now to FIGS. 1, 8, and 9, the novel locking means of the invention for locking the cover to the base is there illustrated. The locking means here comprises a finger actuated panel 90 which is pivotally connected to cover 32 for pivotal movement about a pivot pin 92 which is carried by cover 32. Fixed at one end of panel 90 is a hasp-like assembly 94 that includes a downwardly depending apertured plate 95. The locking means of the invention is movable from the first unlocked position shown in FIG. 8 to the locked position shown in FIG. 9 wherein the aperture provided in plate 95 indexes with an aperture provided in a staple-like member 96 which is affixed to base 30. With the cover in the closed position shown in FIG. 9, a force exerted on the lower portion of plate 90 in the direction of the arrow 97 will cause the aperture within plate 95 to move into alignment with the aperture provided in plate 96 so that the shackle of a padlock 98 can be inserted through the indexed apertures. Upon locking the padlock, pivotal movement of cover 92 relative to base 30 about hinge member 34 is positively prevented and the unauthorized opening of the container is prevented.

The base and cover of the transport container of the present invention can be constructed of a number of different materials, but is preferably constructed from a foam-filled, light-weight, durable, high-impact plastic. Similarly, the container can be made in various sizes to accommodate various sizes and number of feature film release prints.

In accordance with the method of the invention, the release prints are first wound on the plastic cores 14 and the cores and the film are placed within the transport container. The container and the film is then transported directly to the theater. At the theater, the cover is opened and the release prints are wound directly onto the projection platter by unwinding them from the cores which are rotatably supported within saddles 52.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A transport container for transporting theatrical release prints wound upon a central core comprising:

(a) axle means for interconnection with the core for rotation therewith;

(b) a base having walls defining at least one cavity for receiving the prints wound upon the core, said walls having bearing means for rotatably supporting said axle means; and (c) cover means connected to said base for enclosing the prints disposed within said base, said cover means including retaining means for retaining said axle means in position within said bearing means, said retaining means comprising at least one outwardly extending finger movable into close proximity with said axle means when said cover encloses the prints disposed within said base.

2. A transport container as defined in claim 1 in which said base comprises first and second side walls and first and second intermediate walls, said first side wall and said first intermediate wall defining a print receiving cavity, said second side wall and said second intermediate wall defining a second print receiving cavity, and said first and second intermediate walls defining a print receiving cavity therebetween.

3. A transport container as defined in claim 2 in which said bearing means comprise axle-receiving, cut-out portions provided in each of said first and second side walls and in each of said intermediate walls.

4. A transport container as defined in claim 3 in which said axle-receiving, cut-out portions are generally "J" shaped in plan.

5. A transport container for transporting lengths of film wound upon cores each of which has a central bore, said container comprising:

(a) axles receivable within the bore of each core for rotation with the core;

(b) a base having an interior space including a plurality of cavities for receiving film wound upon a core, said cavities including bearing means for rotatably receiving said axles; and (c) a cover connected to said base for closing the interior of said base and enclosing the film contained therewithin, said cover including retaining means for retaining said axles within said bearing means, said cover comprising first and second side walls and first and second intermediate walls, said retaining means comprising outwardly extending fingers formed on each of said walls, said fingers being movable into close proximity with said axles when said cover closes the interior of said base.

6. A transport container as defined in claim 5 further including locking means for locking said cover to said base.

7. A transport container as defined in claim 5 in which said base comprises first and second side walls and first and second intermediate walls, said first side wall and said first intermediate wall defining a first film-receiving cavity, said second side wall and said second intermediate wall defining a second film-receiving cavity, and said first and second intermediate walls defining a third film-receiving cavity therebetween.

8. A transport container as defined in claim 7 in which one of said first and second side walls is provided with at least one stacking protuberance and the other of said first and second side walls is provided with at least one nesting cavity.

9. A transport container as defined in claim 7 in which said bearing means comprise axle receiving saddles provided in each of said first and second side walls and in each of said intermediate walls.

10. A transport container as defined in claim 7 in which each of said first and second intermediate walls of said cover is provided with a disk receiving cavity for removably receiving an audio disk.

11. A transport container for transporting lengths of film wound upon a plurality of cores each of which has a central bore, said container comprising:

(a) a plurality of axles, one axle being receivable within the bore of each core for rotation with the core;

(b) a base comprising first and second side walls and first and second intermediate walls, said first side wall and said first intermediate wall defining a film-receiving cavity, said second side wall and said second intermediate wall defining a second film-receiving cavity and said first and second intermediate walls defining a film-receiving cavity therebetween;

(c) bearing means provided in each said side and intermediate wall for rotatably receiving said axles;

(d) a cover connected to said base, said cover including:

(i) first and second spaced apart side walls;

(ii) first and second intermediate walls disposed between said side walls; and (iii) retaining means provided on each said side wall and said intermediate wall for retaining said axles within said bearing means, said retaining means comprising outwardly extending fingers formed on each of said side walls and intermediate walls, said fingers being movable into close proximity with said axles when said cover is superimposed over said base in a closing relationship.

12. A transport container as defined in claim 11 further including locking means for locking said cover to said base.

13. A transport container as defined in claim 11 in which said bearing means comprise axle receiving saddles provided in each of said first and second side walls and in each of said intermediate walls.

14. A transport container as defined in claim 11 in which one of said side walls of said base and said cover is provided with nesting protuberances and the other of said side walls of said base and said cover is provided with nesting cavities.

15. A method of transporting theatrical release prints to a theater for display using a transport container having internally disposed bearing means, comprising the steps of:

(a) winding the release prints onto a plastic core having a central bore;

(b) inserting into said central bore an axle to form a rotatable subassembly;

(c) placing said rotatable subassembly into the transport container with said axle nesting within said bearing means;

(d) transporting the container and said subassembly to the theater; and (e) unwinding the release prints from said plastic core while said axle rotates within said bearing means.

16. A method as defined in claim 15 in which the theater has a projection platter and in which said release prints are unwound from said core directly onto the projection platter.

* * * * *